US005469014A

United States Patent [19]

Itoh et al.

[11] Patent Number: 5,469,014

[45] Date of Patent: Nov. 21, 1995

[54] FIELD EMISSION ELEMENT

[76] Inventors: Shigeo Itoh; Teruo Watanabe; Makoto Miyamori; Norio Nishimura, all of Mobara; Junji Itoh; Seigo Kanemaru, both of Tsukuba, all of Japan

[73] Assignee: Futaba Denshi Kogyo K.K., Mobara-Shi, Electro Laboratory, Agency of Industrial Science and Technology, Tsukuba-Shi; both of Japan

[21] Appl. No.: 829,251

[22] Filed: Feb. 3, 1992

[51] Int. Cl.[6] ..... H01J 1/30

[52] U.S. Cl. ..... 313/308; 313/633; 313/309; 313/311; 313/336; 313/355; 315/169.4

[58] Field of Search ..... 313/308, 497, 313/558, 633, 309, 311, 310, 326, 332, 336, 351, 355, 562; 315/169.4; 345/37, 75

[56] References Cited

U.S. PATENT DOCUMENTS

| | | | |
|---|---|---|---|
| 3,998,678 | 12/1976 | Fukase et al. | 313/336 X |
| 4,410,832 | 10/1983 | Smith et al. | 313/336 X |
| 4,663,559 | 5/1987 | Christensen | 313/336 X |
| 4,835,438 | 5/1989 | Baptist et al. | 313/336 X |
| 4,990,766 | 2/1991 | Simms et al. | 313/336 X |
| 5,012,153 | 4/1991 | Atkinson et al. | 313/309 X |
| 5,136,205 | 8/1991 | Sokolich et al. | 313/336 X |
| 5,189,341 | 2/1993 | Itoh et al. | 313/309 X |
| 5,256,936 | 10/1993 | Itoh et al. | 313/309 X |

*Primary Examiner*—Sandra L. O'Shea
*Assistant Examiner*—Ashok Patel
*Attorney, Agent, or Firm*—Oblon, Spivak, McClelland, Maier & Neustadt

[57] ABSTRACT

A field emission element including a gate and an emitter and capable of preventing any of the element oxide layer from being formed on a tip of the emitter to prevent a decrease in emission current, unstable operation and an increase in noise. The gate has a surface formed of a material of oxygen bonding strength higher than that of a material for at least a tip surface of the emitter, so that oxygen atoms and molecules containing oxygen entering the gate may be captured by adsorption on the gate to prevent formation of any oxide layer on the emitter. When a portion of the emitter other than the tip surface is formed of a material of oxygen bonding strength higher than that of the material for the tip surface, formation of any oxide layer on the tip surface of the emitter is minimized.

4 Claims, 2 Drawing Sheets

FIELD EMISSION ELEMENT

BACKGROUND OF THE INVENTION

1. Field of the Invention

This invention relates to a field emission element, and more particularly to a field emission element which is useful as an electron source for various kinds of devices such as a display device, a light source, an amplification element, a high-speed switching element, a sensor and the like.

2. Discussion of the Background

The manufacturing and structure of a conventional field emission element (FEC) will be described in connection with a Spindt-type (vertical type) field emission element shown in FIGS. 4*a* to 4*e*.

In manufacturing of the conventional field emission element of the Spindt type, as shown in FIG. 4*a*, a cathode electrode 101, an insulating layer 102 and a gate electrode layer 103 are laminatedly deposited in that order on an insulating substrate 100.

Then, a resist is deposited on the gate electrode layer 103 and exposure of a gate pattern of 1 μm in diameter is successively carried out by means of light beams or electron beams. Subsequently, a portion of the resist which has been subject to exposure is removed and the gate electrode layer 103 and insulating layer 102 are subject to etching, thereby to form a gate 104 and a hole 105 as shown in FIG. 4*b*.

Subsequently, the resist is removed and then an Al layer 106 is obliquely downwardly deposited on a surface of the insulating substrate 100 while the insulating substrate 100 is rotated in the same plane, resulting in an opening of the gate 104 being contracted and a peel layer being formed as shown in FIG. 4*c*.

Next, as shown in FIG. 4*d*, the deposition of an emitter material 107 on the Al layer 106 is carried out vertically downwardly toward the substrate 100 to form an emitter 108 of a cone-like shape in the hole 105.

Thereafter, as shown in FIG. 4*e*, the obliquely deposited Al layer 106 and unnecessary emitter material 107 are removed, leading to the field emission element.

In the conventional field emission element formed as described above, a metal of a high melting point which has a reduced work function, such as Mo or the like is used as a material for the emitter and gate. Unfortunately, the use of such a metal is made without consideration as to the reaction of Mo or the like with oxygen atoms or molecules of a compound containing oxygen during operation of the field emission element in a vacuum atmosphere and as to an optimum combination of materials for the emitter and gate.

SUMMARY OF THE INVENTION

The present invention has been made in view of the foregoing disadvantage of the prior art while taking notice of the fact that the reaction between Mo and oxygen is relatively strong to cause an oxide insulating layer to be readily formed on Mo, so that operation of a field emission element under a vacuum pressure as low as $10^{-4}$ to $10^{-6}$ Torr causes Mo of the emitter to react with residual gas or emitted gas to form a compound, resulting in the work function of a part of the emitter being increased, leading to a decrease in emission current and unstable operation, as well as an increase in generation of noise and failure in field emission by the emitter.

Accordingly, it is an object of the present invention to provide a field emission element which is capable of stably exhibiting satisfactory emission characteristics for a long period of time.

It is another object of the present invention to provide a field emission element which is capable of minimizing generation of noise.

These and other objects are achieved in accordance with the present invention by providing a new and improved field emission element including an emitter, a gate and an anode, wherein the gate has a surface made of a material exhibiting oxygen bonding strength higher than that of a material for a tip surface of the emitter.

Also, in accordance with another embodiment of the present invention, the field emission element includes an emitter and a gate, wherein at least a tip surface of the emitter is made of a material exhibiting oxygen bonding strength lower than that of a material for the remaining part of the emitter.

In the field emission element of the present invention constructed as described above, the surface of the gate is made of a material of oxygen bonding strength higher than that of a material for the surface of each of the emitter and the anode, so that oxygen atoms entering the gate may be positively captured by the gate to prevent formation of any oxide layer on the emitter. When a portion of the emitter other than the tip surface is formed of a material of oxygen bonding strength higher than that of a material for the tip surface, production of any oxide layer on the tip surface of the emitter is minimized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Now, a field emission element according to the present invention will be described hereinafter with reference to the accompanying drawings.

The inventors, as a result of study on optimum combination of materials for a gate and an emitter, considered that when a gate is made of a material which combines with oxygen at relatively high bonding strength or exhibits relatively high oxygen bonding strength and each of an emitter and an anode is made of a material which combines with oxygen at relatively small bonding strength or exhibiting relatively low oxygen bonding strength, oxygen is held on the gate by adsorption to prevent an oxide layer from being formed on the emitter and anode. Then, the stability and bonding energy of various materials were evaluated in the light of Gibbs free energy of each of the materials, so that a material which meets the above consideration was selected for each of the electrodes. More specifically, it was found that when Ti and Cr are selected as a material suitable for the gate, which combines with oxygen at high bonding strength, whereas W, Mn, Ta, Nb, TiN, TiC and Mo are selected as a material for each of the emitter and anode, which combine with oxygen at relatively low bonding strength, the combination between both materials is optimum for the gate and emitter.

Preparation of the above-described electrodes from these materials may be carried out using any suitable method known in the art such as vacuum deposition, sputtering or the like. When a field emission element of the present invention includes an emitter and a gate and at least a tip surface of the emitter is formed of a material exhibiting low oxygen bonding strength as compared with a material for the remaining part of the emitter, TiN and TiC are advantageously used for the tip surface of the emitter. This is due to the fact that it is possible initially generally to form the emitter of Ti and then convert only a surface layer of the emitter into TiN or TiC by ion implantation of nitrogen or oxygen, thermal nitriding, carbonization or the like. This relatively facilitates formation of an emitter of a two-layer structure wherein Ti is used for an emitter base and a TiN or TiC layer is formed on the emitter base.

Figure 1:
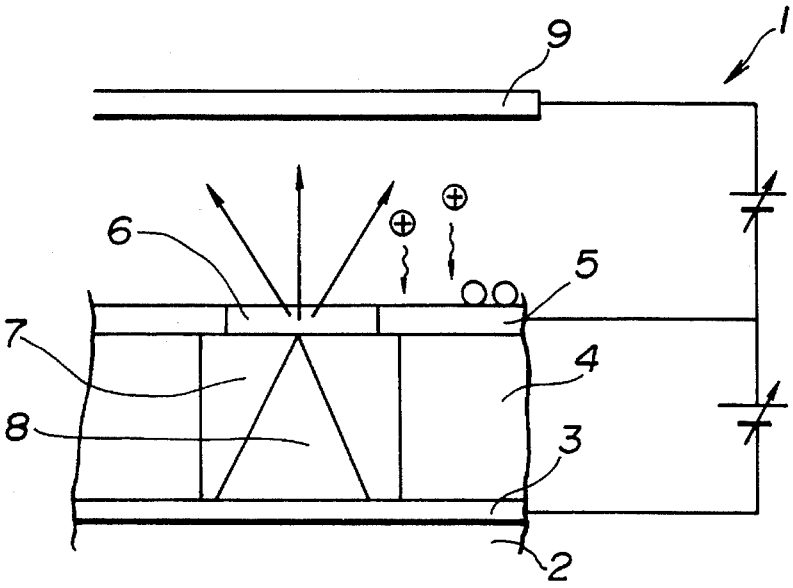
FIG. 1 is a schematic side view showing an embodiment of a field emission element according to the present invention.

Referring now to the drawings, wherein like reference numerals designate identical or corresponding parts throughout the several views, and more particularly to FIG. 1 thereof.

Obviously, numerous (additional) modifications and variations of the present invention are possible in light of the above teachings. It is therefore to be understood that within the scope of the appended claims, the invention may be practiced otherwise than as specifically described herein. A first embodiment of a field emission element according to the present invention will be described. In FIG. 1, a field emission element of the illustrated embodiment generally indicated at reference numeral 1 includes a substrate 2 made of glass, silicon or the like. The field emission element 1 also includes a cathode electrode 3 formed into a stripe pattern and arranged on the substrate 2. The cathode electrode 3 is made of an ITO into a thickness of 0.2 μm by photolithography. On the cathode electrode 3 is deposited an insulating layer 4, which is formed of $SiO_2$ into a thickness of 1.0 μm by CVD techniques. Also, on the insulating layer 4 is arranged a gate 5, which is formed of Ti or Cr into a thickness 0.4 μm by vacuum deposition. The gate 5 is formed with apertures 6 of 1 μm in diameter, which are arranged at intervals of 10 μm. Correspondingly, the insulating layer 4 is formed with holes 7. The apertures 6 and holes 7 are formed by etching. In each of the holes 7 is formed an emitter 8 of a conical shape, which is made of a material selected from the group consisting of W, Mn, Ta, Nb, TiN, TiC and Mo. Reference numeral 9 designates an anode made of a metal material or a metal film. In the case of a display element, anode 9 is made of a phosphor, an ITO, a glass substrate or the like. The above-described respective electrodes are housed in a vacuum envelope (not shown). Also, a positive potential of a predetermined level is applied to each of the gate 5 and anode 9 with respect to the emitter 8. The remaining part of the process of manufacturing the field emission element 1 which has not been described above may be carried out in substantially the same manner as the prior art.

When the field emission element 1 of the illustrated embodiment constructed as described above is operated in a low vacuum atmosphere, electrons emitted from the emitter 8 travel through the apertures 6 of the gate 5 to the anode 9. At this time, the gate 5 acts as a getter positively to capture oxygen atoms and physically and/or chemically adsorbed oxygen atoms thereon. This permits a partial pressure of oxygen and the like in the field emission element to be reduced, resulting in preventing a tip surface of the emitter from which electrons are emitted from being formed with an oxide insulating layer.

Also, in addition to the above-described construction for permitting the gate 5 to capture oxygen and the like naturally entering the gate, the illustrated embodiment may be further constructed so that a voltage of a suitable level is applied between the gate 5 and the anode 9 to ionize atoms and/or molecules of oxygen and the like in a vacuum region between the gate 5 and the anode 9, which is expected to have a relatively high ionization probability, and then the ionized atoms and molecules are caused forcibly to enter the gate 5 with high energy, thereby to be captured by the gate.

Figure 2:
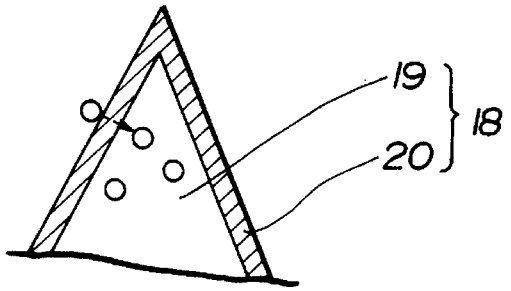
FIG. 2 is a fragmentary enlarged cross-sectional view showing an essential part of another embodiment of a field emission element according to the present invention.

Now, another or second embodiment of a field emission element according to the present invention will be described with reference to FIG. 2.

A field emission element of the illustrated embodiment is constructed in substantially the same manner except that an emitter 18 is constructed into a two-layer structure. More particularly, the emitter 18 includes an emitter base 19 formed of Ti or Cr into a cone-like shape and a cover layer 20 arranged on the emitter base 19 and formed of a material selected from the group consisting of W, Mn, Ta, Nb, TiN, TiC and Mo into a thickness of about 0.1 μm by vapor deposition.

Thus, the emitter 18 of the second embodiment is constructed so that a material , exhibiting high bonding strength when it combines with atoms and/or molecules of oxygen and the like is used for a base portion of the emitter and a material exhibiting low bonding strength with respect to the atoms and/or molecules of oxygen is used for forming a surface portion of the emitter. Such construction permits the atoms and/or molecules entering the surface of the emitter 18 to be adsorbed on the pump which functions to the like entering the gate 5 emitter base 19 without forming any oxide layer on the surface of the emitter 18. This indicates that the cover layer 20 forming the surface portion of the emitter 18 is constantly kept at a reduced condition.

Figure 3:
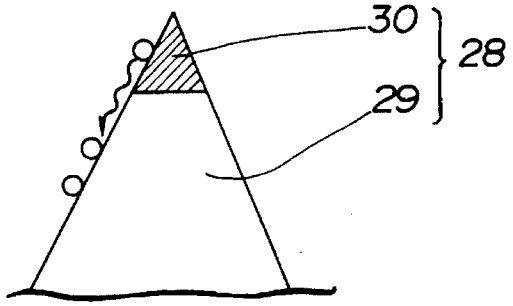
FIG. 3 is a fragmentary enlarged cross-sectional view showing an essential part of a further embodiment of a field emission element according to the present invention.
Figure 4A:
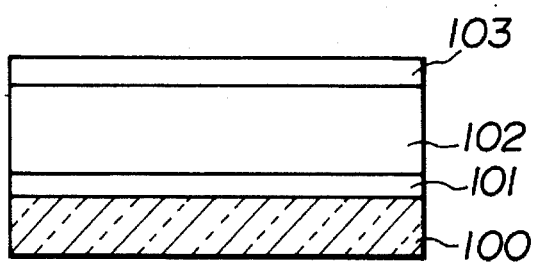
FIG. 4(a) PRIOR ART
FIGS. 4*a* to 4*e* are schematic views showing steps of a process for manufacturing a conventional field emission element.
Figure 4D:
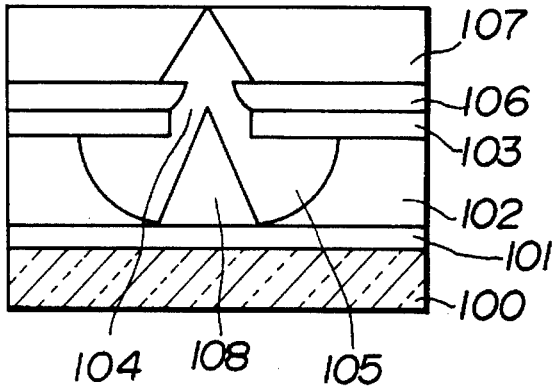
FIG. 4(d) PRIOR ART
Figure 4B:
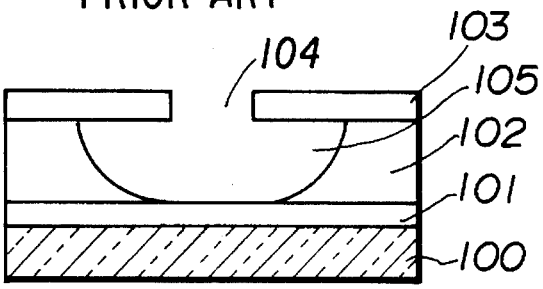
FIG. 4(b) PRIOR ART
Figure 4E:
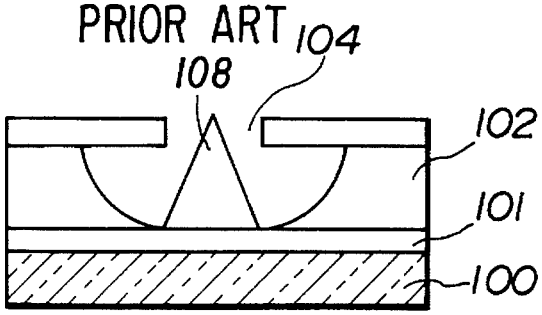
FIG. 4(e) PRIOR ART
Figure 4C:
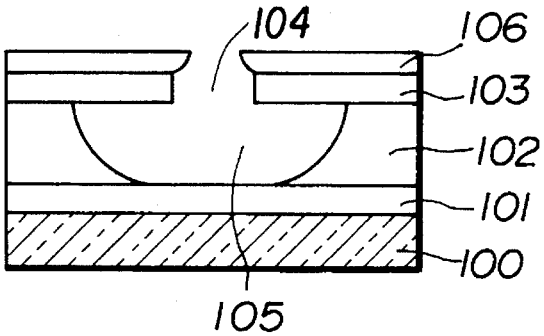
FIG. 4(c) PRIOR ART

FIG. 3 shows a further or third embodiment of a field emission element according to the present invention, which is constructed in substantially the same manner as the embodiment shown in FIG. 1, except that an emitter 28 is formed with a two-stage structure. More particularly, the emitter 28 includes an emitter base 29 made of Ti or Cr into a frust-conical shape and an emitter tip 30 formed of a material selected from the group consisting of W, Mn, Ta, Nb, TiN, TiC and Mo into a conical shape and arranged on the emitter base.

Thus, the emitter base 29 which accounts for a large part of the emitter 28 is made of a material which combines with atoms and/or molecules of oxygen and the like at high bonding strength and the tip 30 of the emitter 28 is made of a material low in oxygen bonding strength as compared with the material for the emitter base 29, so that the atoms and/or molecules entering the tip 30 are adsorbed on the material for the emitter base 29 without forming any oxide layer. Alternatively, the atoms and/or molecules entering the emitter base 29 are likewise absorbed thereon, thereby to be prevented from forming any oxide layer due to diffusion of the atoms and/or molecules onto the tip 30.

The above-described embodiments are directed to a field emission element of the Spindt type, however, the present invention is likewise applicable to a lateral-type (flat-type) field emission element.

The second and third embodiments described above each are constructed in substantially the same manner as the first embodiment except for the emitter 18 or 28. However, each of the emitters 18 and 28 in the second and third embodiments per se fully exhibits the advantages described above.

As can be seen from the foregoing, the field emission element of the present invention permits oxygen atoms, molecules containing oxygen and the like entering the tip surface of the emitter to be adsorbed on the gate and emitter base made of a material exhibiting high bonding strength with respect to the atoms and molecules. Therefore, the tip surface of the emitter from which electrons are emitted is constantly kept clean to prevent formation of any oxide insulating layer on the tip surface. This ensures that the emission characteristics of the field emission element are maintained stable and satisfactory for a long period of time and generation of any noise is minimized.

While preferred embodiments of the invention have been described with a certain degree of particularity with reference to the drawings, obviously modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A field emission element comprising:

an emitter having a tip portion; and a gate;

said emitter tip portion comprising a material exhibiting an oxygen bonding strength lower than that of a material for the remaining portion of said emitter.

2. A field emission element as defined in claim 1 wherein said emitter is formed at at least said tip portion thereof, of a material selected from the group consisting of W, Mn, Ta, Nb, TiN, TiC and Mo and at the remaining portion thereof of Ti or Cr.

3. The field emission element according to Claim 1, wherein said tip portion is arranged at a distal end of said remaining portion.

4. A field emission element, comprising:

an emitter; and a gate;

said emitter including a base portion formed of a material having a first oxygen bonding strength, said emitter having a cover layer formed thereon, said cover layer being formed of a material having a second oxygen bonding strength lower than said first oxygen bonding strength.

* * * * *

UNITED STATES PATENT AND TRADEMARK OFFICE

CERTIFICATE OF CORRECTION

PATENT NO. : 5,469,014

DATED : November 21, 1995

INVENTOR(S) : Shigeo ITOH, et al.

It is certified that error appears in the above-indentified patent and that said Letters Patent is hereby corrected as shown below:

On the title page, Item [73], the second assignee's name, should read:

--Electronical Laboratory, Agency of Industrial Science and Technology--

Signed and Sealed this

Twenty-eighth Day of May, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,469,014

DATED : November 21, 1995

INVENTOR(S) : Shigeo ITOH et al.

It is certified that error appears in the above-indentified patent and that said Letters Patent is hereby corrected as shown below:

On the title page, Item [30], the Foreign Application Priority Data is missing from the Letters Patent. It should read:

--[30] Foreign Application Priority Data

Feb. 8, 1991 [JP] Japan ..... 3-037794--

Signed and Sealed this

Twenty-third Day of July, 1996

*Attest:*

Bruce Lehman

BRUCE LEHMAN

*Attesting Officer*

*Commissioner of Patents and Trademarks*